US006626565B2

(12) United States Patent
Ishida

(10) Patent No.: US 6,626,565 B2
(45) Date of Patent: Sep. 30, 2003

(54) VEHICLE HEADLAMP

(75) Inventor: Hiroyuki Ishida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/050,638

(22) Filed: Jan. 15, 2002

(65) Prior Publication Data

US 2002/0093827 A1 Jul. 18, 2002

(30) Foreign Application Priority Data

Jan. 16, 2001 (JP) ..... P.2001-008339

(51) Int. Cl.[7] ..... F21V 101/10

(52) U.S. Cl. ..... 362/514; 362/517; 362/304; 362/346

(58) Field of Search ..... 362/517, 512, 362/516, 514, 346, 304

(56) References Cited

U.S. PATENT DOCUMENTS 4,831,506 A 5/1989 Miyazawa ..... 362/284
5,060,120 A * 10/1991 Kobayashi et al. ..... 362/61
5,070,432 A * 12/1991 Kitazumi et al. ..... 362/61
6,039,466 A * 3/2000 Duchenne et al. ..... 362/515
6,471,383 B1 * 10/2002 Oyama et al. ..... 362/517

FOREIGN PATENT DOCUMENTS

JP H01-109603 4/1989
JP H5-174602 7/1993

* cited by examiner

*Primary Examiner*—Laura K. Tso
(74) *Attorney, Agent, or Firm*—Koda & Androlia

(57) ABSTRACT

A vehicle headlamp having a lamp unit that emits a beam in a low beam light distribution pattern which includes a hot zone, the lamp unit being formed by a lamp unit main body and a pair of secondary reflectors provided on both sides of the lamp unit main body. The lamp unit main body emits, via a main reflector, a beam that covers a wide area with the base light distribution pattern; and the secondary reflectors, installed so as to swing horizontally with respect to the lamp unit main body, emit a beam that has light distribution patterns forming the hot zone. The secondary reflectors swing and move the position of the hot zone to the right or left, thus illuminating the road ahead even when the vehicle is running on a curved road with the base light distribution pattern kept facing the vehicle front direction.

8 Claims, 13 Drawing Sheets

VEHICLE HEADLAMP

BACKGROUND OF THE INVENTION

1. Field of the Invention

The present invention relates to a vehicle headlamp that emits a beam by a lamp unit housed inside a lamp body.

2. Prior Art

A vehicle headlamp emits a beam in a predetermined light distribution pattern by means of a lamp unit that includes a light source and a reflector that reflects the light from the light source forward. A "hot zone" (which is a high luminous intensity area) of the light distribution pattern is formed at an area near the center of the light distribution pattern so as to enhance the visibility of a road ahead of a vehicle.

Under actual vehicle running conditions, however, the vehicle runs not only on a straight road but also on a curved road. Accordingly, it is preferable that, when the vehicle is running on a curved road, the light distribution pattern sufficiently illuminates the road surface slantwise in front of the vehicle. If, however, the entire light distribution pattern is set to face the frontal portion of the curved road, the luminous intensity decreases in the area from the vehicle front direction to the leftward direction on, for example, a right curved road, giving a driver an uneasy feeling.

It is possible to change the light distribution pattern according to the vehicle running conditions. For instance, in Japanese Patent Application Laid-Open (Kokai) No.H01-109603, a pair of auxiliary reflectors are provided between the light source and the reflector, and these auxiliary reflectors are supported so as to swing in a lateral direction with respect to the reflector. The light distribution pattern changes by way of swinging these auxiliary reflectors.

However, in this vehicle headlamp, two auxiliary reflectors are provided at positions closer to the light source than the reflector. As a result, an image of the light source formed by the light reflected by the auxiliary reflectors becomes large, which, in turn, makes the distribution pattern of the emitted light large. As a result, when the auxiliary reflectors swing, the entire shape of the light distribution pattern changes, but the position of the hot zone makes almost no changes. It is, therefore, difficult to sufficiently enhance the visibility of the road surface ahead when the vehicle runs on a curved road.

SUMMARY OF THE INVENTION

Accordingly, the object of the present invention is to provide a vehicle headlamp that is formed by housing a lamp unit inside a lamp body and that is capable of emitting a beam in a light distribution pattern that can be changed in response to the vehicle running conditions.

The above object is accomplished by a unique structure for a vehicle headlamp of the present invention; and in the present invention, a pair of reflectors that form the hot zone are provided on both (left and right) sides of a lamp unit main body, and these reflectors are provided so as to swing in the lateral direction with respect to the lamp unit main body.

More specifically, the vehicle headlamp of the present invention comprises a lamp body and a lamp unit. The lamp unit is housed inside the lamp body and emits forward a beam of a predetermined light distribution pattern that has a hot zone. This lamp unit is comprised of a lamp unit main body and a pair of second reflectors. The lamp unit main body includes a light source and a first reflector that supports the light source and reflects the light from the light source forward. The second reflectors are provided on the left and right sides of the lamp unit main body so as to reflect the light entered thereinto from the light source forward and form the hot zone. The lamp unit main body is supported in the lamp body, and the second reflectors are provided so as to swing in a lateral direction with respect to the lamp unit main body.

The structure of the "lamp unit main body" is not specifically limited to a particular lam unit main body. It is, for example, a so-called parabola type lamp unit main body that has a first reflector formed with respect to a paraboloid of revolution or the like. Alternatively, it can be a projector type lamp unit main body. The projector type lamp unit main body used in the present invention is comprised of: a light source disposed in substantially coaxial with an optical axis extending in a longitudinal direction of a vehicle, a first reflector that reflects a light from the light source forward and close to the optical axis, a condensing lens provided in front of the first reflector, and a shade disposed between the condensing lens and the first reflector so as to shield part of the light reflected by the first reflector.

The "light source" is not specifically limited to a particular light source in the present invention. It can be a discharge light emitting portion of a discharge bulb, or it can be a filament of an incandescent bulb or the like such as a halogen bulb.

The lamp unit main body in the lamp body is fixedly installed. Nonetheless, it is preferable that the supporting the lamp unit main body be supported in a tiltable fashion in a vertical direction and in a lateral direction from a viewpoint of permitting accurate optical axis adjustment. In the present invention, however, the second reflectors that form the hot zone are provided so as to swing in the lateral direction by the lamp unit main body. Thus, it can be designed so that the lamp unit main body is not tiltable in the lateral direction, and this design would not hinder the optical axis adjustment.

As described above, in the vehicle headlamp of the present invention, the lamp unit housed inside the lamp body emits forward a beam of a predetermined light distribution pattern that has a hot zone. In addition, the lamp unit includes the lamp unit main body that has the first reflector and the pair of second reflectors installed on both sides of the lamp unit main body. Furthermore, the lamp unit main body is supported by the lamp body, and each of the second reflectors freely swings in the lateral direction with respect to the lamp unit main body. Accordingly, the present invention provides the operational effects as described below.

Each of the second reflectors is provided so as to swing in the lateral direction with respect to the lamp unit main body; and the position of the hot zone is, by the swing motion of the second reflectors, moved in the lateral direction with the entire shape of the light distribution pattern facing the vehicle front direction.

Accordingly, by way of swinging each of the second reflectors in the lateral direction with respect to the lamp unit main body according to the vehicle running conditions, the light reflected by each of the second reflectors are sufficiently illuminated on the road surface ahead in the vehicle traveling direction when the vehicle is running not only on a straight road but also on a curved road. In addition, since the light reflected by the first reflector keeps its illumination in the vehicle front direction widely at all times, the driver is prevented from feeling unsecured even while driving on a curved road in the dark.

Thus, according to the present invention, the vehicle headlamp formed by housing the lamp unit in the lamp body emits a beam in a light distribution pattern that is variable in response to the vehicle running conditions.

In the above structure, the second reflectors swing in the lateral direction integrally with each other or in conjunction with each other. However, the second reflectors can be designed so as to swing independently. With this design, the light reflected by each of the second reflectors can be directed to any desired direction, which allows more finely controlled light distribution according to the vehicle running conditions.

Furthermore, in the present invention, the positions of the swing axis of respective second reflectors are not particularly fixed. By way of setting the swing axis positions on a perpendicular axis that passes through the point near the light source, the shape of the distribution pattern formed by the light reflected by each of the second reflectors (and thus the shape of the hot zone) is less likely deformed when each of the second reflectors swings in the lateral direction. As a result, a proper beam control is attainable even when the vehicle runs on a curved road.

In addition, in the present invention, each of the second reflectors is supported by the lamp unit main body at two points, the upper and lower portions, of each second reflector. Thus, each of the second reflectors swings in the lateral direction in a state being supported at its upper and lower points. As a result, the accuracy of the swing angle position of each of the second reflectors is enhanced, and the light distribution pattern formed by the light reflected by each of the second reflectors is effectively prevented from being blurred, that would be caused by, for instance, vibrations of the vehicle.

The specific structure of the "lamp unit main body" is not limited as described earlier. It can be of the projector type lamp unit main body in which an opening is formed in each of the right and left sides of the first reflector so as to allow the light from the light source to enter each of the second reflectors.

In other words, with an adoption of the projector type lamp unit main body, a wide solid angle to be used for the first reflector can be secured, which, in turn, makes the light distribution pattern formed by the light reflected by the first reflector brighter. In the projector type lamp unit main body, the light from the light source entering the right and left sides of the first reflector functions little as an effectively reflected light in terms of light distribution performance of the lamp unit main body. Therefore, with the opening formed in each of the right and left sides of the first reflector, the light from the light source enters each of the second reflectors through the opening. As a result, it is possible to obtain a new light reflected by each of the second reflectors, hardly impairing the light distribution performance of the lamp unit main body.

DETAILED DESCRIPTION OF THE INVENTION

Figure 1:
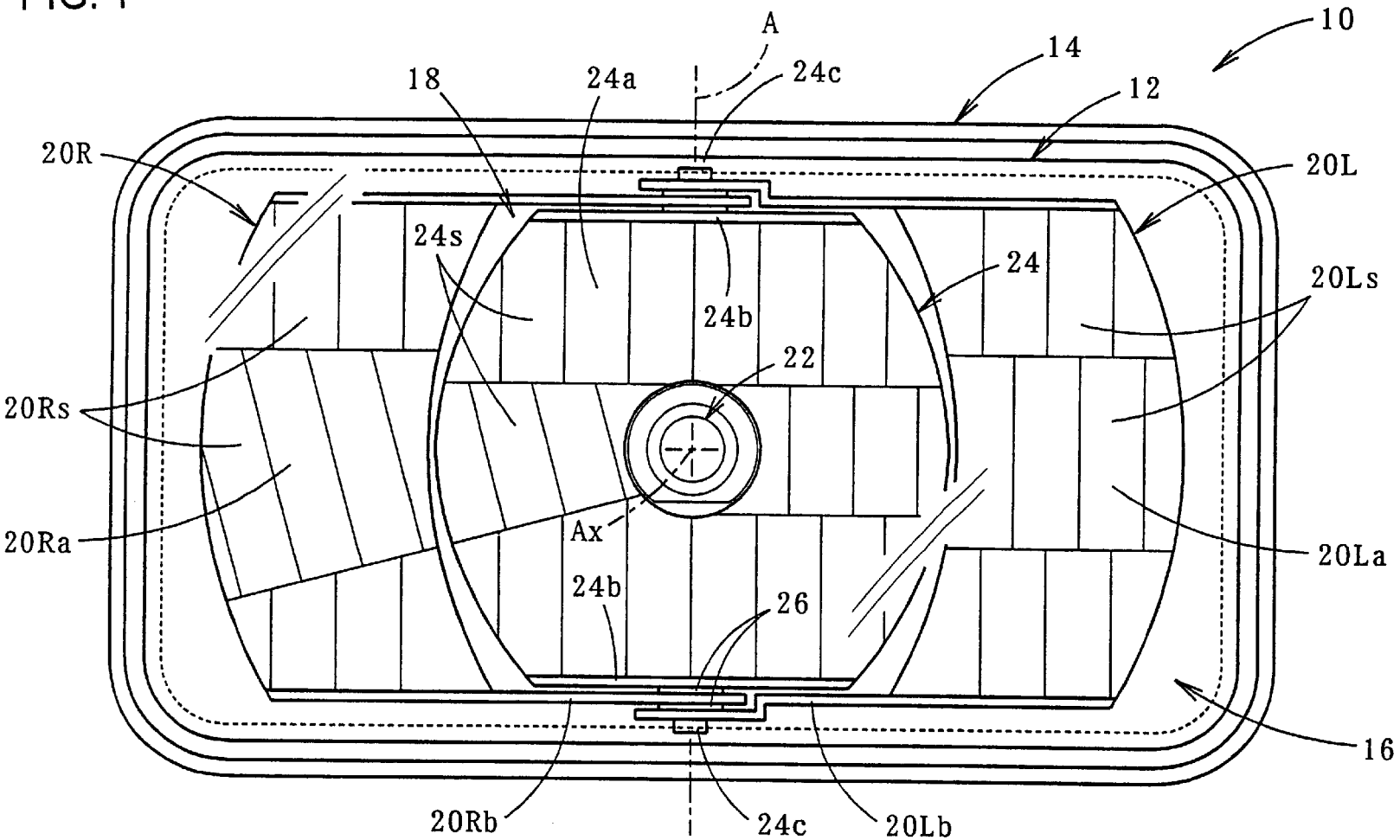
FIG. 1 is a front view of the vehicle headlamp according to the first embodiment of the present invention.
Figure 2:
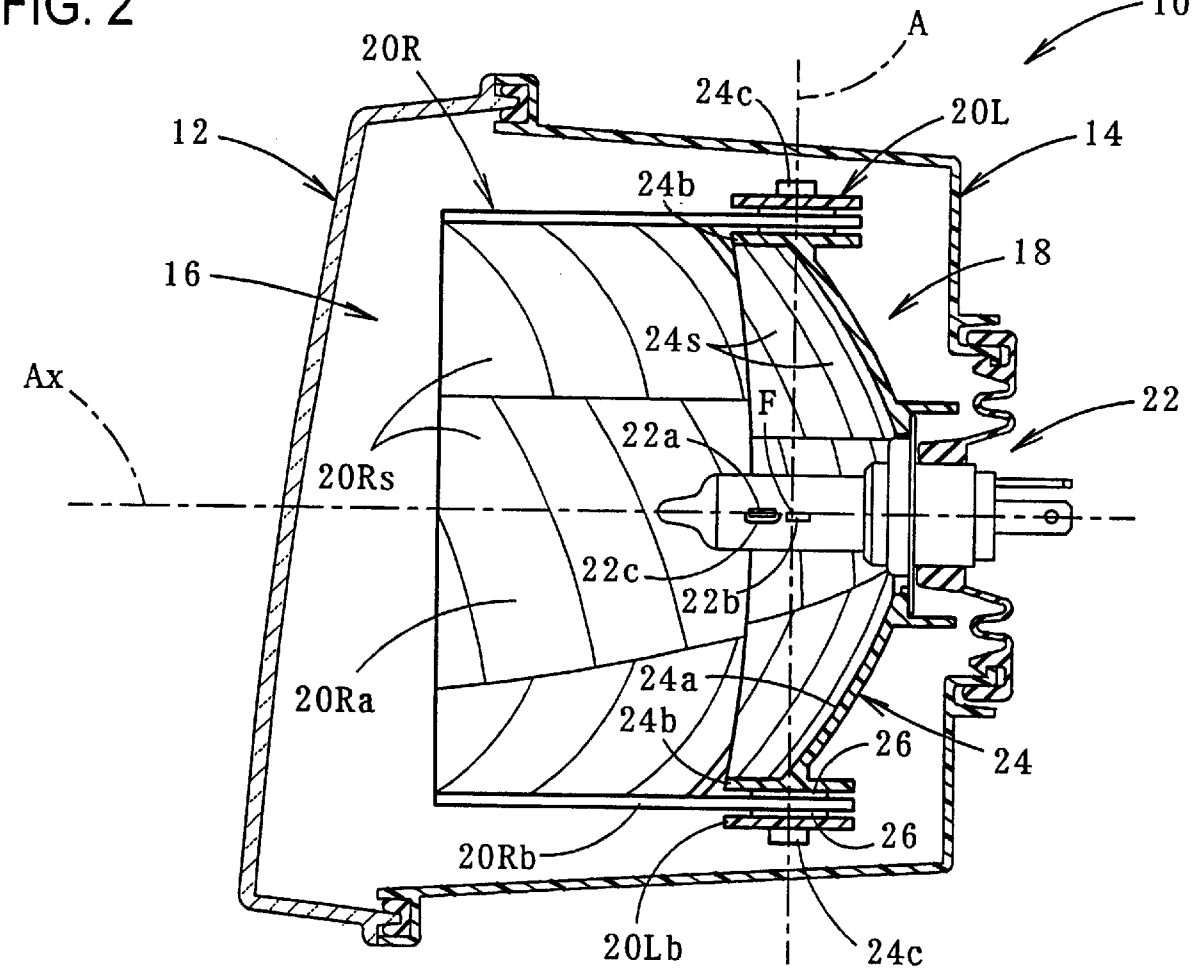
FIG. 2 is a side cross-sectional view thereof.

Embodiments of the present invention will be described below with reference to the accompanying drawings.

The first embodiment of the present invention is illustrated in FIGS. 1 through 7.

As shown in these Figures, a vehicle headlamp 10 according to the first embodiment is comprised of a lamp chamber formed by a plain transparent cover 12 and a lamp body 14, and a lamp unit 16 is housed in this lamp chamber.

The lamp unit 16 is constructed so as to emit forward a beam using either a low beam light distribution pattern or a high beam light distribution pattern, and it is capable of changing the light distribution pattern according to the vehicle running conditions.

The lamp unit 16 is comprised of a lamp unit main body 18 and a pair of second reflectors 20L and 20R disposed on both sides, left and right sides, of the lamp unit main body 18. The thus structured lamp unit 16 is supported by the lamp body 14 so as to tilt in a vertical direction and in a lateral direction by an aiming mechanism (not shown).

The lamp unit main body 18, which is a parabola type lamp unit main body in this embodiment, includes a light source bulb 22 and a first reflector 24.

The light source bulb 22 is a so-called H4 halogen bulb that has a first filament 22*a* which is turned on during a low beam emission and a second filament 22*b* which is turned on during a high beam emission. A shade 22*c* is provided in proximity to below the first filament 22*a*.

The first reflector 24 of the lamp unit main body 18 has a reflecting surface 24*a* formed with a plurality of reflecting elements 24 having a predetermined surface shape. The reflecting surface 24*a* has a plurality of reflecting elements 24*s*. These reflecting elements 24*s* are formed on a paraboloid of revolution that has an optical axis Ax which extends in a longitudinal direction as a central axis and a focal point F at a position closer to the front end of the second filament 22*b*. The light source bulb 22 is fitted to the rear end portion of the first reflector 24. The first reflector 24 diffuses, deflects and reflects forward the light from the light source (the filaments 22*a* and 22*b* of the light source bulb 22) by means of the reflecting elements 24*s*.

Figure 3:
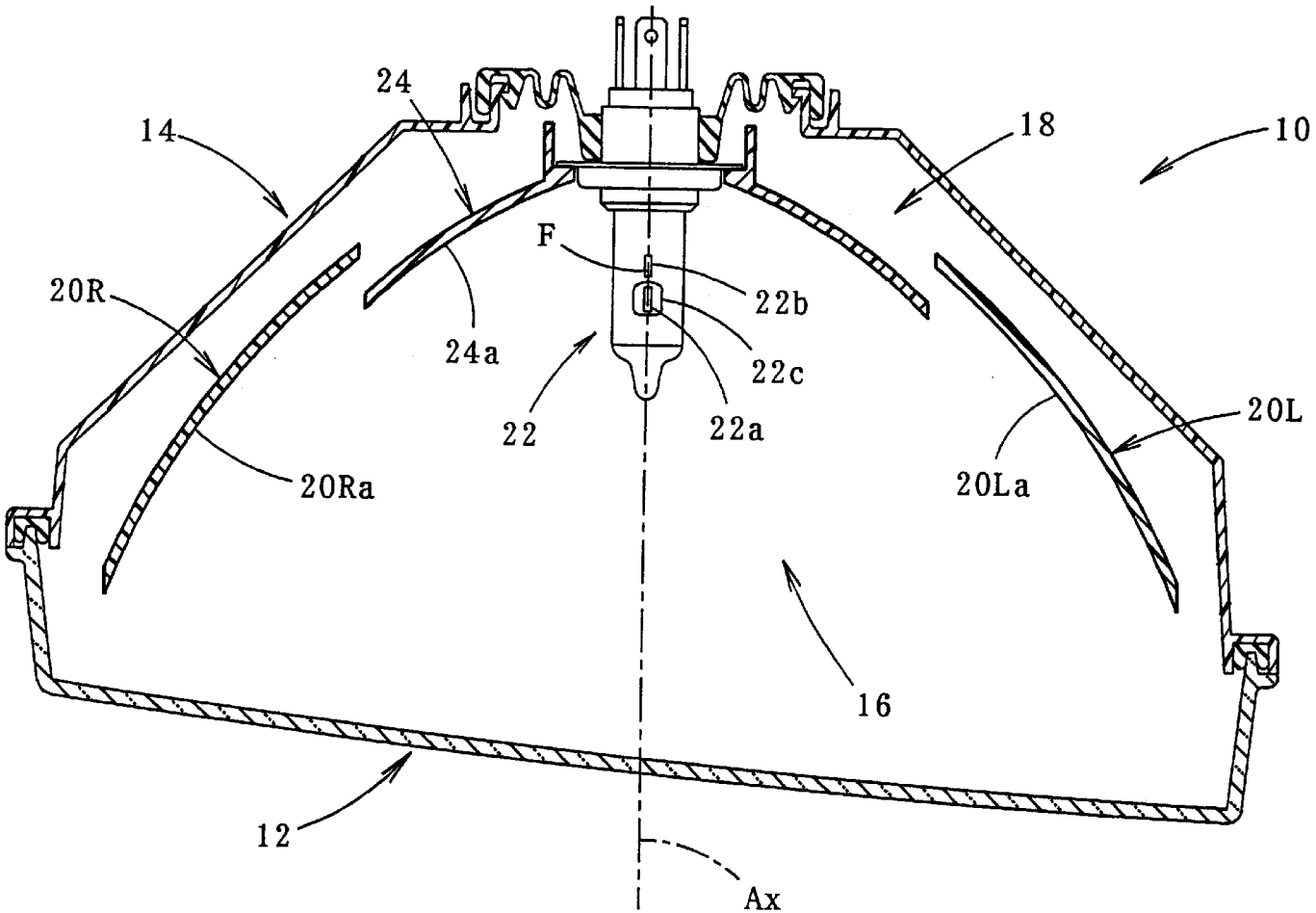
FIG. 3 is a top cross-sectional view thereof.

Each of the second reflectors 20L and 20R of the lamp unit 16 extends forward from the location near the right and left peripheral edges of the first reflector 24 as best seen from FIG. 3. The second reflectors 20L and 20R are designed so that the light emitted from the light sources or the filaments 22*a* and 22*b* at the front side of the first reflector 24 in the lateral direction enters each of the reflecting surfaces 20L*a* and 20R*a*. Each of the reflecting surfaces 20L*a* and 20R*a* is formed by a plurality of reflecting elements 20L*s* and 20R*s* that have a prescribed surface shape on a paraboloid of revolution with the optical axis Ax as the central axis thereof. The reflecting surfaces 20L*a* and 20R*a* diffuse, deflect and reflect the light from the light sources 22*a* and 22*b* forward with their reflecting elements 20L*s* and 20R*s*. The paraboloid of revolution that serves as a reference plane for each of the reflecting surfaces 20L*a* and 20R*a* has a focal length slightly longer than that for the paraboloid of revolution that serves as the reference plane for the reflecting surface 24*a* of the first reflector 24. The focal point F is set in the same manner as that of the reflecting surface 24*a*.

Each of the second reflectors 20L and 20R is supported so as to freely swing or turn in the lateral direction with respect to the lamp unit main body 18. The swing axis A of each of the second reflectors 20L and 20R is, as seen from FIG. 2, established so as to be on the perpendicular axis that passes through the focal point F. Each of the second reflectors 20L and 20R is supported by the lamp unit main body at two points, upper and lower portions, thereof. So as to achieve this, a pair of swing axis portions 24*c* that protrude upward and downward, respectively, along the perpendicular axis passing through the focal point F are formed on the upper and lower wall surface portions 24*b* of the first reflector 24, and tip portions of the upper and lower wall surface extension portions 20L*b* and 20R*b* of the second reflectors 20L and 20R are supported, so as to freely swing or turn, by the swing axis portions 24*c* with spacers 26 in between FIG. 4 shows a single piece of lamp unit 16, in which the first filament 22*a* (that is, the light source for low beam emission) of the light source bulb 22 is light up.

Figure 4:
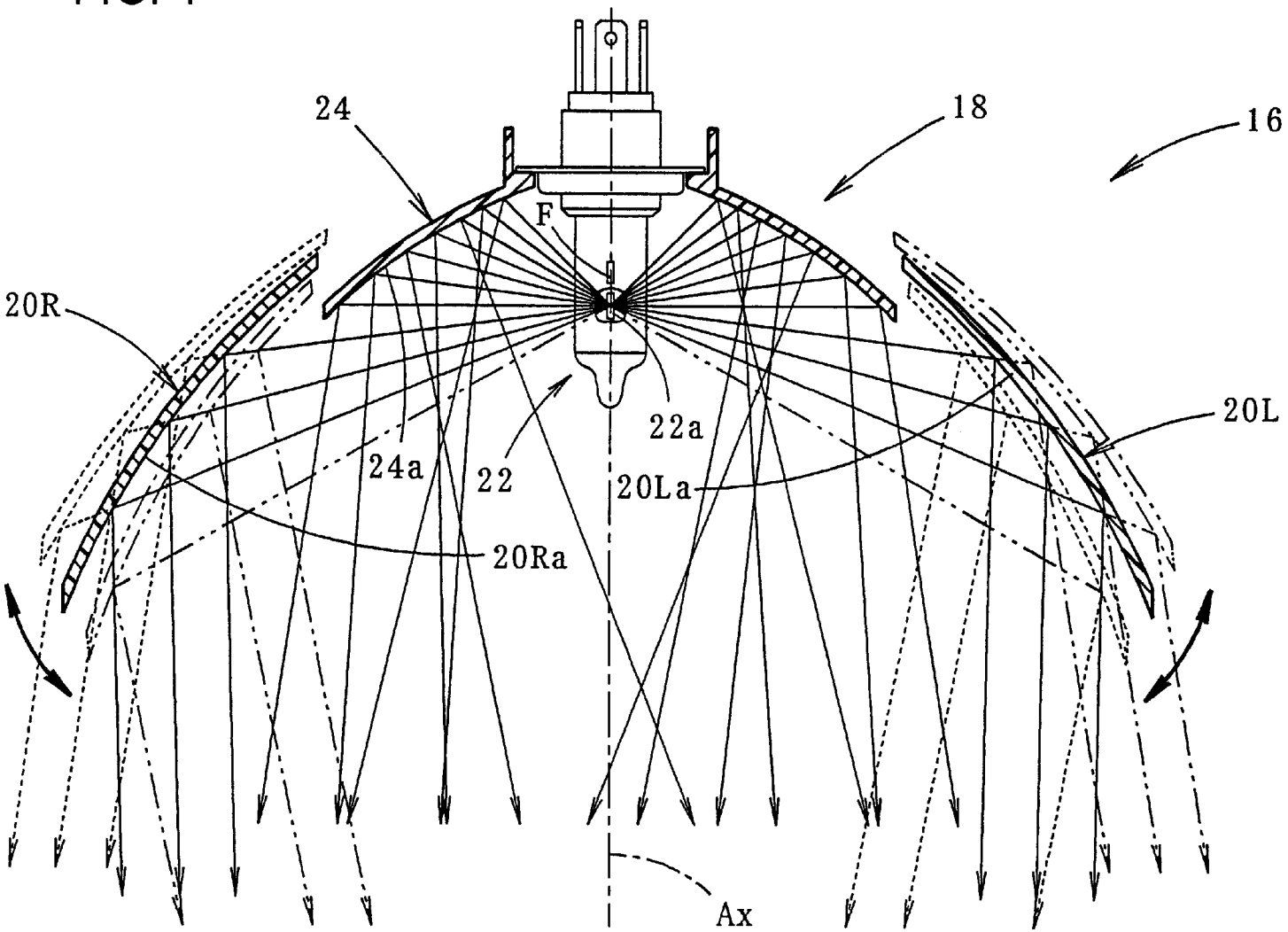
FIG. 4 is a top cross-sectional view thereof showing only the lamp unit.

As seen from FIG. 4, the light reflected by the reflecting surface 24*a* of the first reflector 24 is emitted in a fixed direction, while each of the light reflected by the reflecting surfaces 20L*a* and 20R*a* of the second reflectors 20L and 20R is emitted in a direction that varies according to the position at which each of the second reflectors 20L and 20R has turned.

More specifically, each of the second reflectors 20L and 20R shown by the solid lines in FIG. 4 is in a reference position, at which the beam of the reflected light is in the front forward direction. The position shown by the chain double-dashed lines represents a leftward swing position where each of the second reflectors 20L and 20R has turned to the left, at which the beam of the reflected light is in diagonally forward to the left side. The position shown by the dashed lines represents a rightward swing position where each of the second reflectors 20L and 20R has turned to the right, at which the reflected light is in diagonally forward to the right side.

Figure 5:
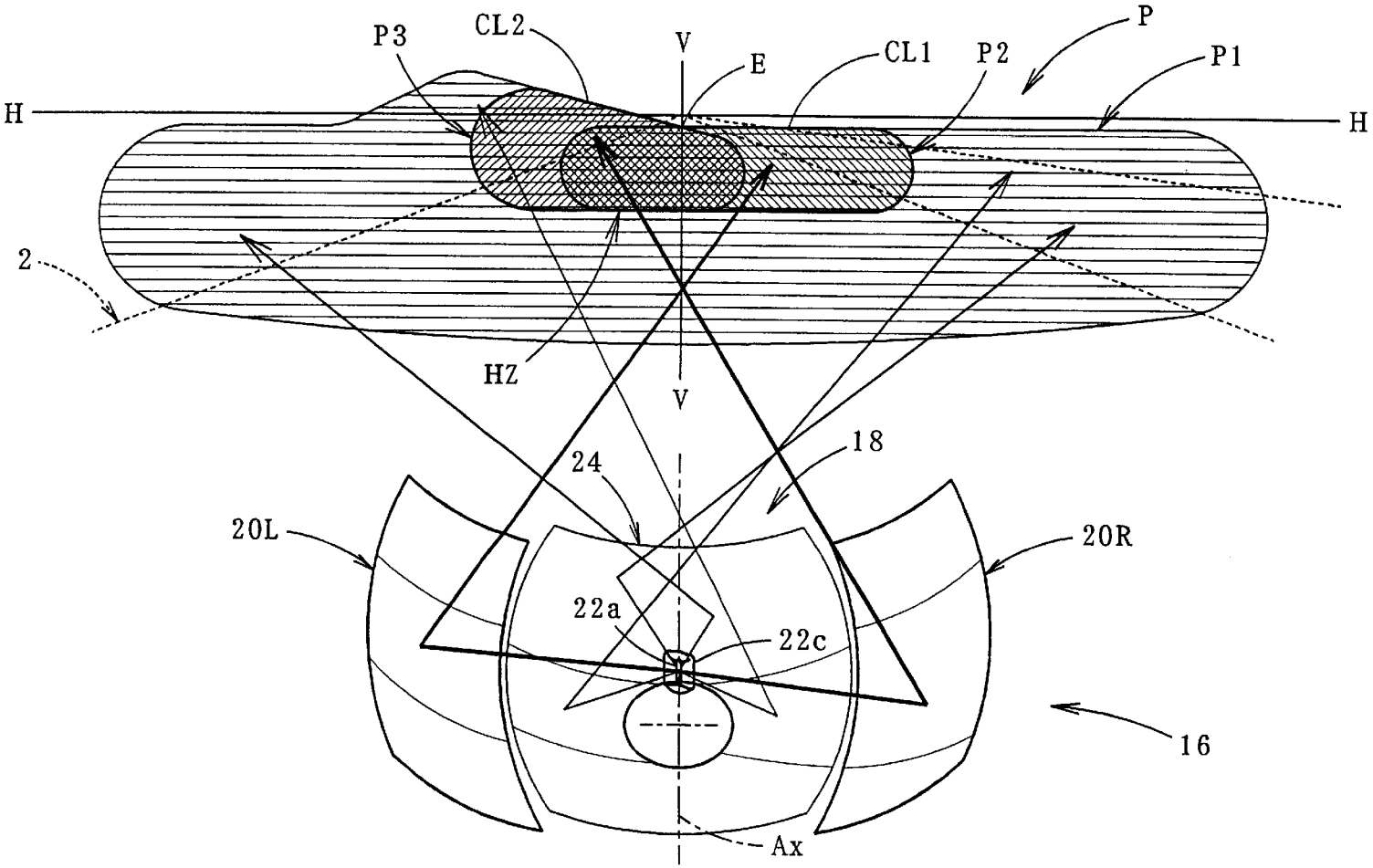
FIG. 5 is a perspective view taken from the back side of the lamp unit showing, together with the lamp unit, the low beam light distribution pattern formed by the beam emitted forward from the lamp unit, with each of the second reflectors being in the reference position.

FIG. 5 is a perspective view taken from the back of the lamp unit 16, showing the lamp unit 16 and the low beam light distribution pattern P formed by the beam emitted forward from the lamp unit 16. In FIG. 5, each of the second reflectors 20L and 20R is in the reference position As seen from FIG. 5, the low beam light distribution pattern P is a light distribution pattern that has a horizontal cutoff line CL1 and an oblique cutoff line CL2 and is designed so as to illuminate widely the vehicle traveling path 2 that is ahead of the vehicle. In this low beam light distribution pattern P, the horizontal cutoff line CL1 set at a position slightly lower than line H—H is on the opposing lane side (which is on the right side of the vehicle in FIG. 5), and the oblique cutoff line CL2 that obliquely rises in the leftward from the horizontal cutoff line CL1 is on the forward-going lane side, thereby protecting the driver on an oncoming vehicle from glare and ensuring good forward visibility for the driver on the vehicle.

The low beam light distribution pattern P comprises a base light distribution pattern P1, a light distribution pattern P2 that forms the right-side hot zone, and a light distribution pattern P3 that forms the left-side hot zone.

The base light distribution pattern P1 illuminates the entire area of the low beam light distribution pattern P. The base light distribution pattern P1 is formed by the light reflected by the first reflector 24.

The light distribution pattern P2 that forms the right-side hot zone and the light distribution pattern P3 that forms the left-side hot zone are relatively small light distribution patterns that form a hot zone HZ. The light distribution pattern P2 that forms the right-side hot zone is a light distribution pattern which extends along the horizontal cutoff line CL1 and is formed by the light reflected by the left side second reflector 20L. On the other hand, the light distribution pattern P3 that forms the left-side hot zone is a light distribution pattern which extends along the oblique cutoff line CL2 and is formed by the light reflected by the right side second reflector 20R. The hot zone HZ, that is an envelope-curve area formed by the light distribution patterns P2 and P3, is thereby formed at a position near an elbow point E (that is an intersection point between the horizontal cutoff line CL1 and the oblique cutoff line CL2) on a line V—V.

Figure 6:
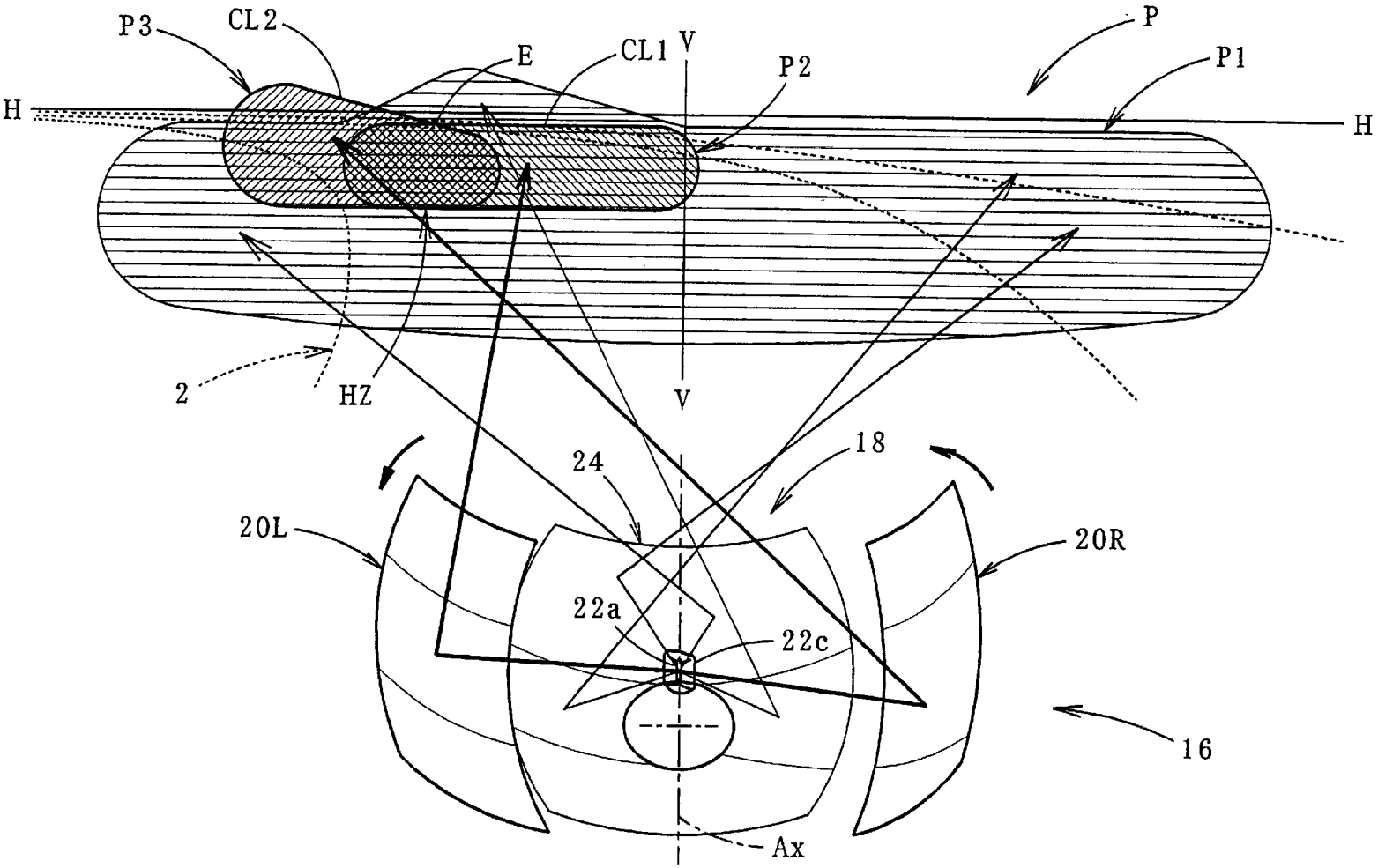
FIG. 6 is a perspective view taken from the back side of the lamp unit showing, together with the lamp unit, the low beam light distribution pattern formed by the beam emitted forward from the lamp unit, with each of the second reflectors in the leftward swing position.

FIG. 6 a perspective view taken from the back side of the lamp unit 16, showing the lamp unit 16 and the low beam light distribution pattern P formed by the beam emitted forward from the lamp unit 16. In FIG. 6, each of the second reflectors 20L and 20R is in the leftward swing position.

As seen from FIG. 6, when each of the second reflectors 20L and 20R is turned into the leftward swing position, the light distribution pattern P2 that forms the right-side hot zone and the light distribution pattern P3 that forms the left-side hot zone are moved to the left with respect to the reference position. As a result, the hot zone HZ is moved, together with the horizontal cutoff line CL1 and the oblique cutoff line CL2, to the left. Thus, when the vehicle traveling path 2 ahead of the vehicle is a leftward curved road, the road surface ahead in the vehicle traveling direction is sufficiently illuminated.

In the shown embodiment, the right side second reflector 20R is swung or turned at an angle that is slightly greater than the left side second reflector 20L so as to move the light distribution pattern P3 that forms the left-side hot zone to the left slightly more than the light distribution pattern P2 that forms the right-side hot zone, thereby illuminating the road surface ahead in the vehicle traveling direction with a wider hot zone HZ. As a result, an overlapped area between the light distribution pattern P2 that forms the right-side hot zone and the light distribution pattern P3 that forms the left-side hot zone in the hot zone HZ becomes smaller to some extent compared to the low beam light distribution pattern P shown in FIG. 5.

The orientation of the base light distribution pattern P1 formed by the light reflected by the first reflector 24 is not moved in the above instance. Accordingly, the base light distribution pattern P1 keeps widely illuminating the vehicle front direction at all times.

Figure 7:
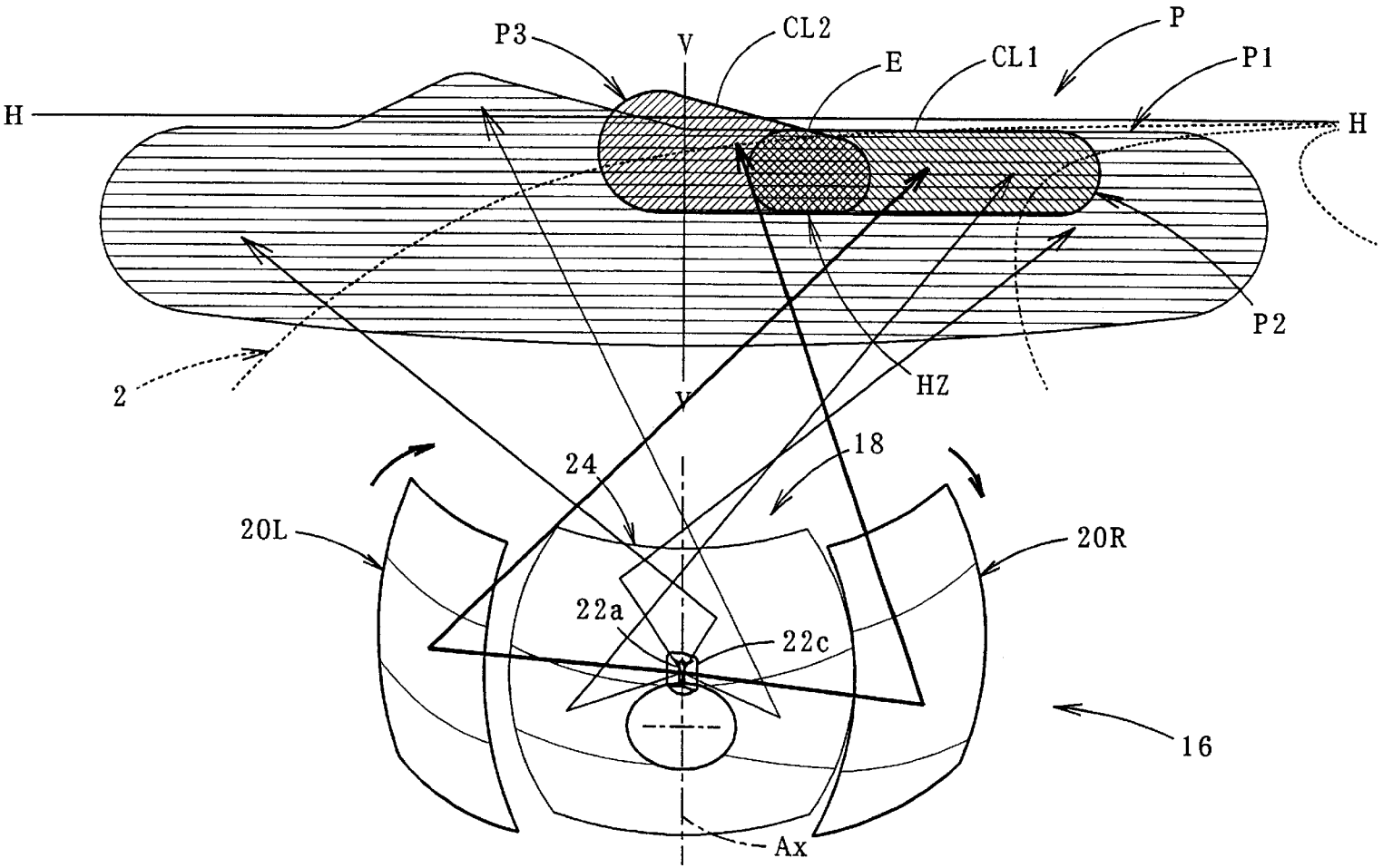
FIG. 7 is a perspective view taken from the back side of the lamp unit showing, together with the lamp unit, the low beam light distribution pattern formed by the beam emitted forward from the lamp unit, with each of the second reflectors in the rightward swing position.

FIG. 7 is a perspective view taken from the back side of the lamp unit 16, showing the lamp unit 16 and the low beam light distribution pattern P formed by the beam emitted forward from the lamp unit 16. In FIG. 7, each of the second reflectors 20L and 20R is in the rightward swing position.

As seen from FIG. 7, when each of the second reflectors 20L and 20R is turned into the rightward swing position, the light distribution pattern P2 that forms the right-side hot zone and the light distribution pattern P3 that forms the left-side hot zone are moved to the right with respect to the reference position. As a result, the hot zone HZ is moved, together with the horizontal cutoff line CL1 and the oblique cutoff line CL2, to the right. Thus, when the vehicle traveling path 2 ahead of the vehicle is a rightward curved road, the road surface ahead in the vehicle traveling direction is sufficiently illuminated. In the shown embodiment, the left side second reflector 20L is swung or turned at an angle that is slightly greater than the right side second reflector 20R so as to move the light distribution pattern P2 that forms the right-side hot zone to the right slightly more than the light distribution pattern P3 that forms the left-side hot zone, thereby illuminating the road surface ahead in the vehicle traveling direction with a wider hot zone HZ. As a result, an overlapped area between the light distribution pattern P2 that forms the right-side hot zone and the light distribution pattern P3 that forms the left-side hot zone in the hot zone HZ becomes smaller to some extent compared to the low beam light distribution pattern P shown in FIG. 6.

The orientation of the base light distribution pattern P1 formed by the light reflected by the first reflector 24 is not moved in the above instance. Accordingly, the base light distribution pattern P1 keeps widely illuminating the vehicle front direction at all times.

As described above in detail, the vehicle headlamp 10 of the above embodiment of the present invention is constructed so that the lamp unit 16 housed inside the lamp body 14 is used so as to emit forward a beam in the low beam light distribution pattern P that has the hot zone HZ. The lamp unit 16 is comprised of the lamp unit main body 18 and the pair of second reflectors 20L and 20R disposed on both sides of the lamp unit main body 18. In addition, the lamp unit main body 18 is supported by the lamp body 14, and each of the second reflectors 20L and 20R is supported so as to swing or turn in the lateral direction with respect to the lamp unit main body 18. Accordingly, the present invention provides the operational effects as described below.

By way of swinging or turning each of the second reflectors 20L and 20R in the lateral direction (or in the left and right directions) with respect to the lamp unit main body 18, it is possible to move the position of the hot zone HZ in the lateral direction (or in the left and right directions) while keeping the base light distribution pattern P1 that has the entire shape of the low beam light distribution pattern P to face the vehicle front direction.

Accordingly, by swinging or turning the second reflectors 20L and 20R in the lateral direction with respect to the lamp unit main body 18 according to the vehicle running conditions, it is possible to have the light reflected by each of the second reflectors 20L and 20R sufficiently illuminated the road surface ahead in the vehicle traveling direction when the vehicle is running not only on a straight road but also on a curved road. In addition, since the light reflected by the first reflector 24 keeps the vehicle front direction widely illuminated at all times, the driver can avoid feeling unsecured even while driving on a curved road.

As seen from the above, the present invention provides a vehicle headlamp that houses a lamp unit in its lamp body and emits a beam in a light distribution pattern which is variable in response to the vehicle running conditions.

Moreover, in the above embodiment, the second reflectors 20L and 20R swing or turn in the lateral direction independently to each other. Accordingly, the light reflected by each of the second reflectors 20L and 20R can be set to any desired direction, which allows more finely controlled light distribution according to the vehicle running conditions.

In addition, in the above embodiment, the position of the swing axis A of each of the second reflectors 20L and 20R is set on a perpendicular axis that passes through the focal point F of the first reflector 24. Accordingly, the shape of the light distribution pattern P2 that forms the right-side hot zone and the light distribution pattern P3 that forms the left-side hot zone, both being formed by the light reflected by the second reflectors 20L and 20R, are less likely to deform (so is the shape of the hot zone HZ) even when each of the second reflectors 20L and 20R is turned in the lateral direction. Accordingly, a proper beam control can be performed even when the vehicle is running on a curved road.

Furthermore, in the above embodiment, each of the second reflectors 20L and 20R is supported by the lamp unit main body 18 at two points thereof or at upper and lower portions of each second reflector. Accordingly, each of the second reflectors 20L and 20R swings in the lateral direction while being supported at two points in the vertical direction. Thus, accuracy of the swing angle position of each of the second reflectors 20L and 20R is enhanced, and the hot zone HZ formed by the light reflected by each of the second reflectors 20L and 20R is prevented from being blurred that would be caused by, for instance, vibrations of the vehicle.

The foregoing embodiment is described with reference to the low beam light distribution pattern P which is formed by the first filament 22*a* of the light source bulb 22. The same effect, however, can be obtained in the present invention for the high beam light distribution pattern that is formed by the second filament 22*b* of the light source bulb 22.

In the case of the high beam light distribution pattern also, the position of the hot zone HZ is moved in the lateral direction by way of swinging each of the second reflectors 20L and 20R in the lateral direction with respect to the lamp unit main body 18, and this can be done while the base light distribution pattern, that has the entire shape of the high beam light distribution pattern P, is kept facing the vehicle front direction. Thus, in the present invention, a high beam illumination that has a light distribution pattern responsive to the vehicle running conditions can be emitted.

The present invention is further descried below for the second embodiment.

Figure 8:
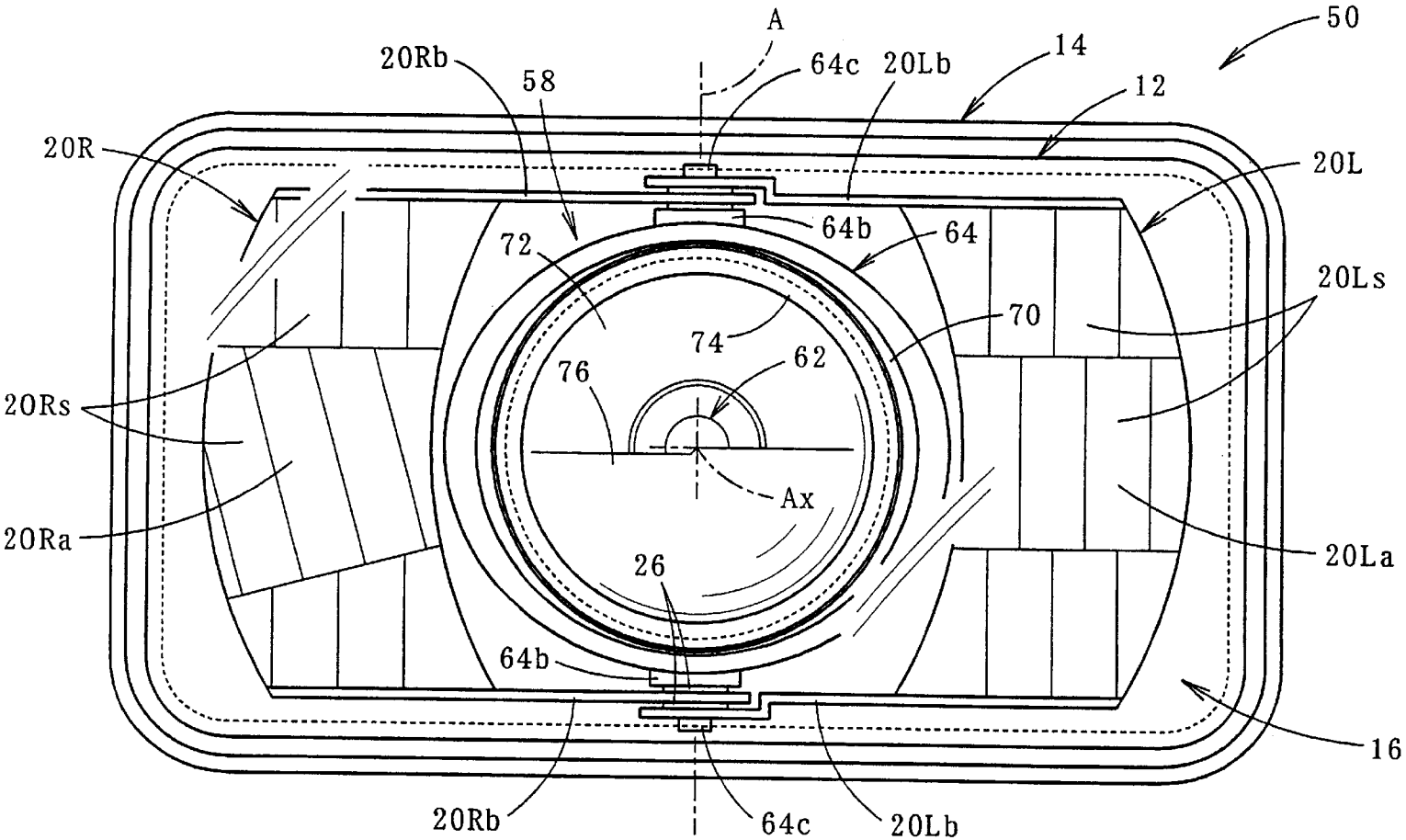
FIG. 8 is a front view of the vehicle headlamp according to the second embodiment of the present invention.
Figure 9:
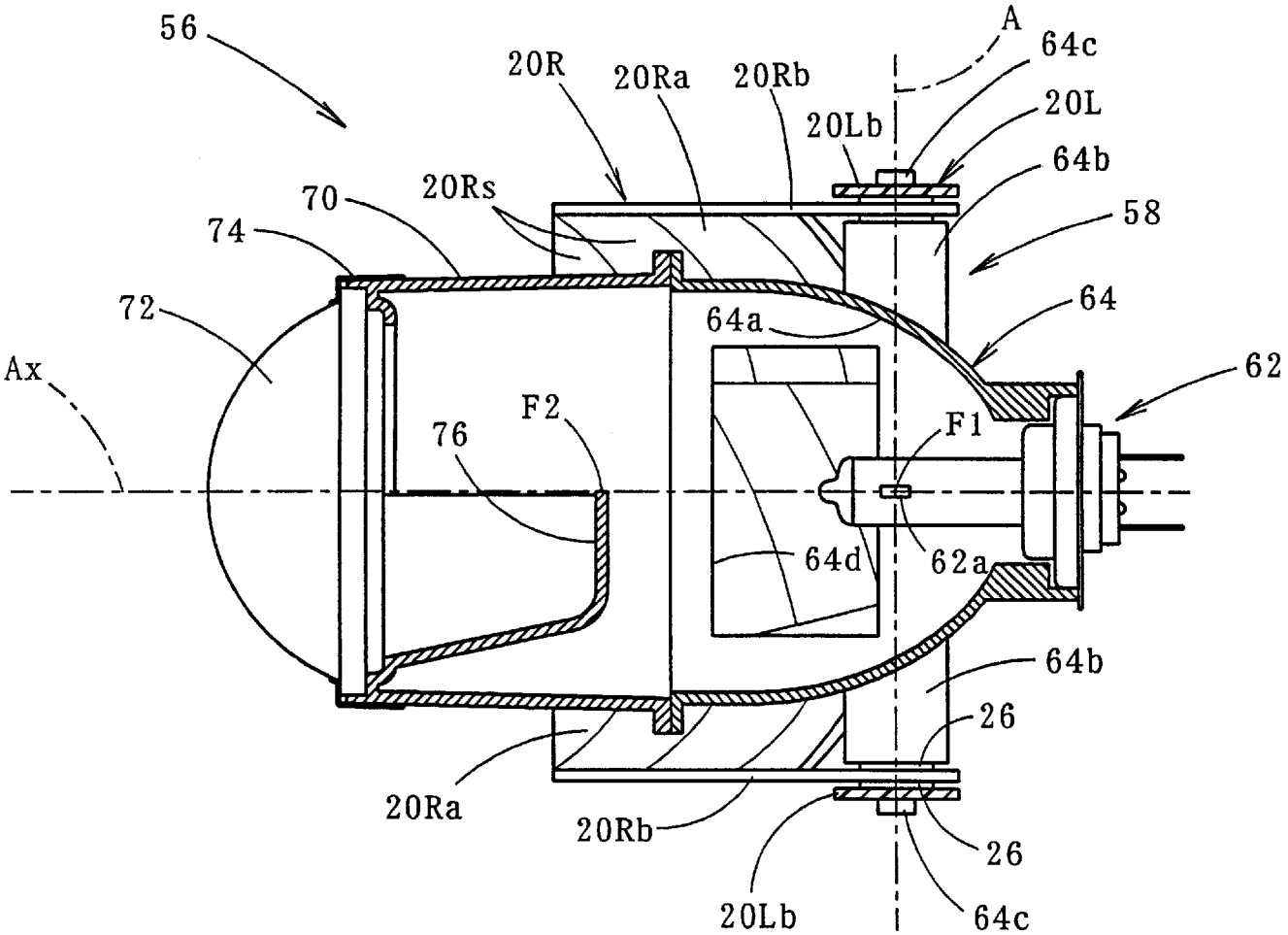
FIG. 9 is a side cross-sectional view thereof.
Figure 10:
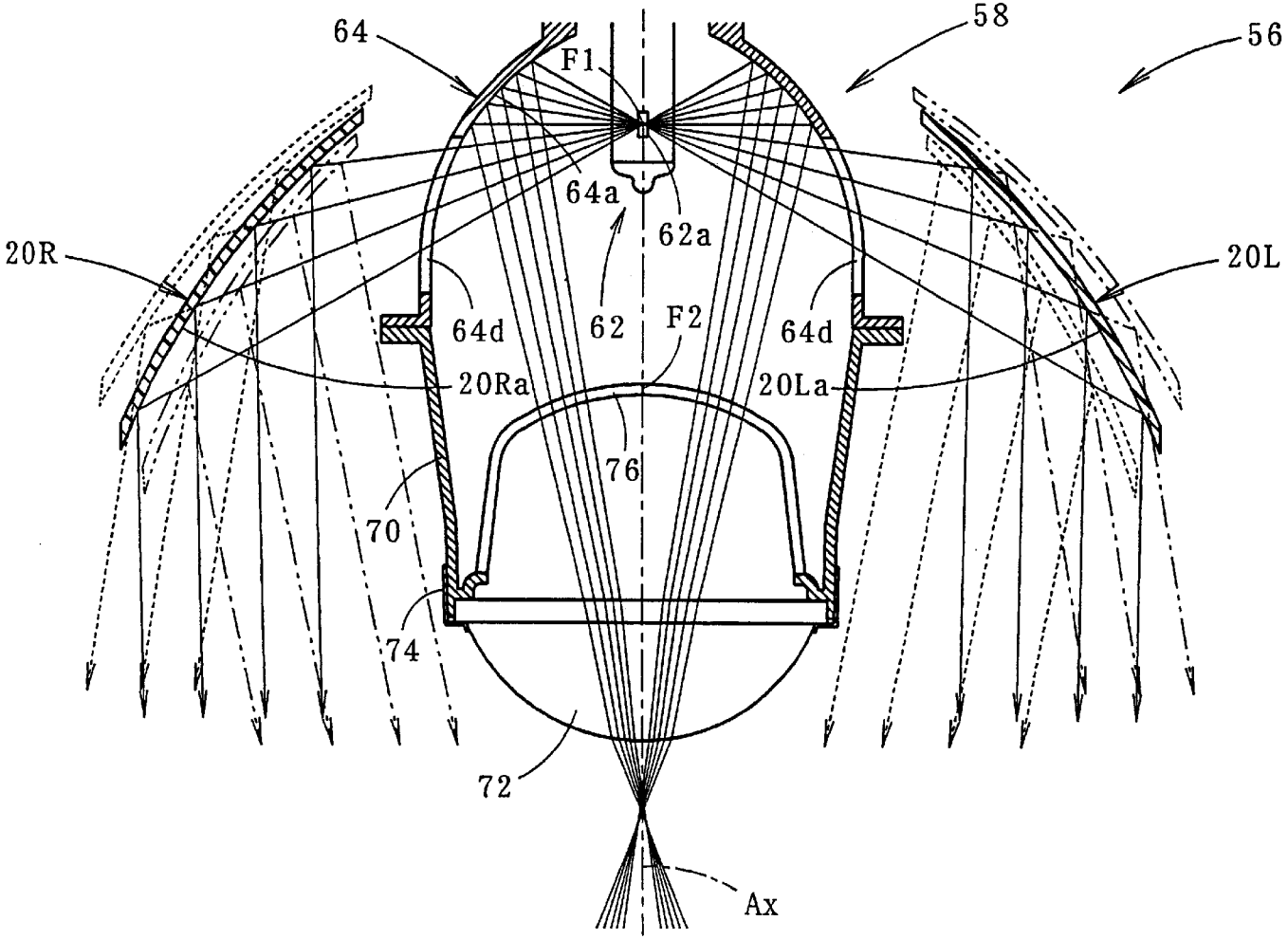
FIG. 10 is a top cross-sectional view thereof.

As seen form FIGS. 8 through 10, in the second embodiment, the vehicle headlamp 50 has the same basic structure as that of the first embodiment, but it differs from the first embodiment in that the lamp unit 56 includes a projector type lamp unit main body 58 and not the parabola type lamp unit main body 18 used in the first embodiment.

In addition, the vehicle headlamp 50 is one that serves exclusively as a headlamp for low beam emission.

The lamp unit main body 58 is comprised of a light source bulb 62, a first reflector 64, a holder 70, a condensing lens 72, a retaining ring 74, and a shade 76.

The light source bulb 62 is a so-called H8 halogen bulb and has the first reflector 64 so that a filament 62*a* (light source) thereof is disposed coaxial with an optical axis Ax.

The first reflector 64 is provided with a reflecting surface 64*a* of a substantially elliptic spherical shape that has the optical axis Ax as a central axis thereof. The cross-sectional shape of the reflecting surface 64*a* that includes the optical axis Ax is an ellipse, and the eccentricity of the ellipse is set so as to gradually increase from a perpendicular cross section toward a horizontal cross section. The apex in the back of the ellipse that forms each of such cross sections is, however, set at the same point.

The light source 62*a* is disposed at a first focal point F1 of the ellipse that forms the perpendicular cross section of the reflecting surface 64*a*. The reflecting surface 64*a* is thereby designed so as to reflect the light from the light source 62*a* forward and close to the optical axis Ax and. Also, the reflecting surface 64*a* substantially converges on the second focal point F2 of the ellipse in the perpendicular cross section that includes the optical axis Ax.

An opening portion 64*d* that allows the light from the light source 62*a* to enter each of reflecting surfaces 20L*a* and 20R*a* of second reflectors 20L and 20R is formed in each of the right and left sides of the first reflector 64.

Each of the second reflectors 20L and 20R is supported so as to freely swing or turn in the lateral direction with respect to the lamp unit main body 58, and the position of a swing axis A of each one of the second reflectors 20L and 20R is established on a perpendicular axis that passes through the first focal point F1. The position of the focal point of the paraboloid of revolution that serves as the reference plane for reflecting surfaces 20L*a* and 20R*a* of each of the second reflectors 20L and 20R is set at the same position as the first focal point F1.

Each of the second reflectors 20L and 20R is supported by the lamp unit main body 58 at two points, on the upper and lower portions, of each of the second reflectors 20L and 20R. To achieve this, a pair of pillar portions 64*b* that protrude upward and downward, respectively, along the perpendicular axis that passes through the first focal point F1 are formed on the first reflector 64. Tip portions of the upper and lower wall surface extension portions 20L*b* and 20R*b* of the second reflectors 20L and 20R are supported, so as to freely swing or turn, by swing axis portions 64*c* formed on tip faces of the pillar portions 64*b* with spacers 26 in between.

The holder 70 is in a cylindrical shape and extends forward from the front end opening portion of the first reflector 64. The holder 70 is, at a rear end thereof, secured to and supported by the first reflector 64 and has, at a front end thereof, the condensing lens 72 with the retaining ring 74 in between.

The condensing lens 72 is a flat convex lens that has a convex surface at a front side thereof and a flat surface on a backside thereof. The condensing lens 72 is disposed so that the position of its focal point in the back coincides with the second focal point F2 of the reflecting surface 64*a* of the first reflector 64. With this arrangement, the condensing lens 72 condenses the light reflected by the reflecting surface 64*a* of the first reflector 64 to a point close to the optical axis Ax and allows the light to transmit therethrough.

The shade 76 is provided between the condensing lens 72 and the first reflector 64. The shade 76 is designed so as to shield part of the light reflected by the reflecting surface 64*a* of the first reflector 64. In other words, the shade 76 extends substantially along a vertical plane that is perpendicular to the optical axis Ax and is disposed so that a top edge thereof that extends horizontally at two different steps on the left and right sides passes through the second focal point F2 as best seen from FIGS. 8 and 9. Thus, the condensing lens 72 shields part of the light reflected by the reflecting surface 64*a,* removes the upward-going light emitted from the lamp unit main body 58, and obtains a low beam emission that is emitted downward with respect to the optical axis Ax.

As seen from FIG. 10, the direction of the beam of the light reflected by the reflecting surface 64*a* of the first reflector 64 is fixed. However, the direction of the beam of the light reflected by each of the reflecting surfaces 20L*a* and 20R*a* of the second reflectors 20L and 20R varies depending on the position of swing or turn of each of the second reflectors 20L and 20R.

More specifically, each of the second reflectors 20L and 20R has a reference position shown by the solid lines, and in this state the direction of the beam of the light is in the front forward direction. The position shown by the chain double-dashed lines is a leftward swing position where each of the second reflectors 20L and 20R has turned to the left, at which the direction of the beam of the light is diagonal forward to the left. The position shown by the dashed lines is a rightward swing position where each of the second reflectors 20L and 20R has turned to the right, at which the direction of the emission of the reflected light is diagonally forward to the right.

Figure 11:
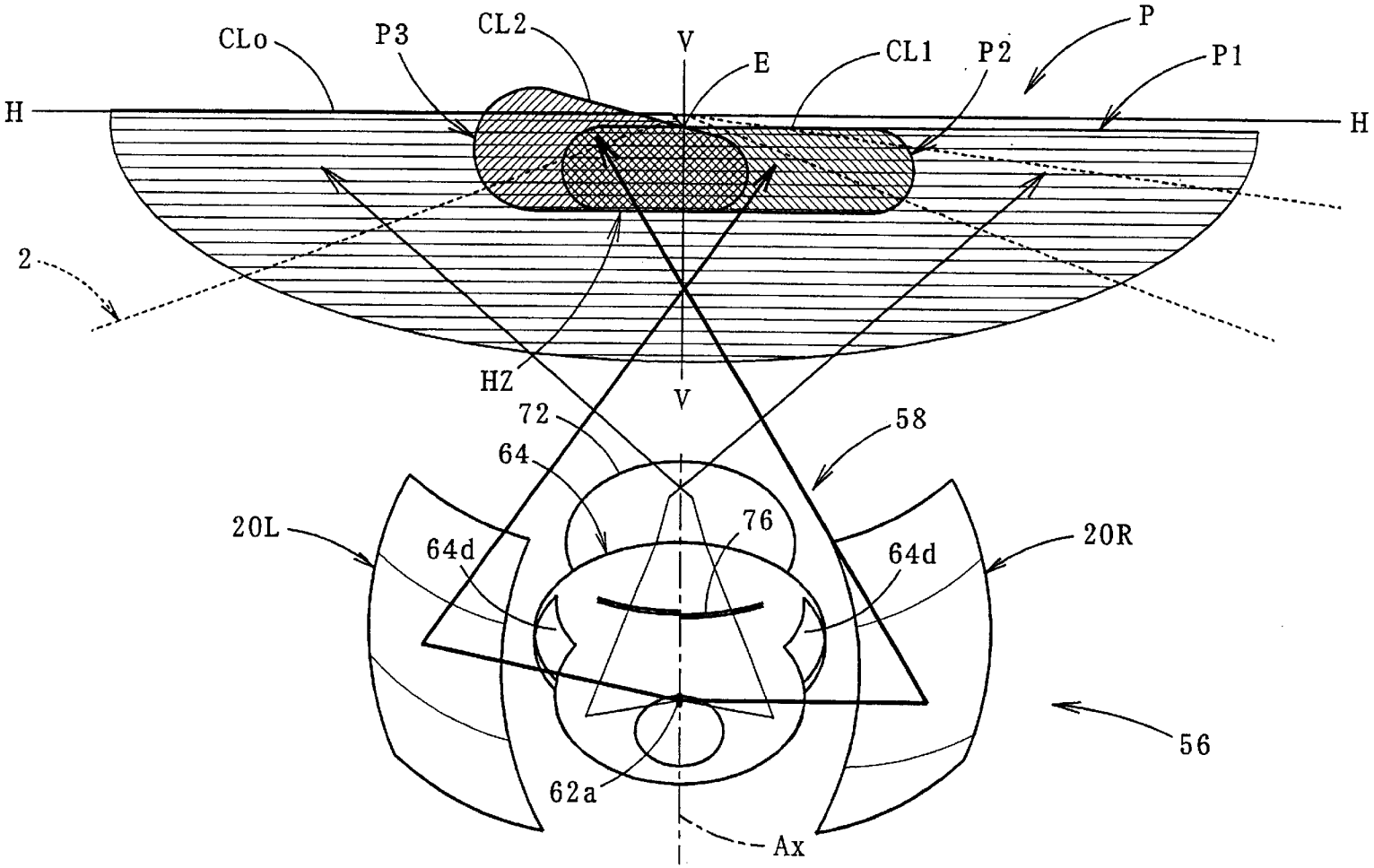
FIG. 11 is a perspective view taken from the back side of the lamp unit showing, together with the lamp unit, the low beam light distribution pattern formed by the beam emitted forward from the lamp unit, with each of the second reflectors in the reference position.

FIG. 11 a perspective view taken from the back of the lamp unit 56, showing the lamp unit 56 and the low beam light distribution pattern P formed by the beam emitted forward from the lamp unit 56. In FIG. 11, each of the second reflectors 20L and 20R is in the reference position.

As seen from FIG. 11, the low beam light distribution pattern P is a light distribution pattern that has a horizontal cutoff line CL1 and an oblique cutoff line CL2, and it illuminates widely the vehicle traveling path 2 ahead of the vehicle. In this low beam light distribution pattern P, the horizontal cutoff line CL1 is on the opposing lane side (which is on the right side of the vehicle in FIG. 11), and the oblique cutoff line CL2 that obliquely rises from the horizontal cutoff line CL1 is on the forward-going lane side, thereby protecting the driver on an oncoming vehicle from glare and ensuring good forward visibility for the driver on the vehicle.

The low beam light distribution pattern P is comprised of a base light distribution pattern P1, a light distribution pattern P2 that forms the right-side hot zone, and a light distribution pattern P3 that forms the left-side hot zone As in the first embodiment, the base light distribution pattern P1 illuminates the entire area of the low beam light distribution pattern P and is formed by the light reflected by the first reflector 64. This base light distribution pattern P1 is designed to form a leftward light distribution low beam light distribution pattern P that has a stepped horizontal cutoff line CLo of two different levels on the right and on the left. The upper level portion of this stepped horizontal cutoff line CLo is set on substantially the same level as the line H—H, while the lower level portion thereof is set on the same level as the horizontal cutoff line CL1 which is slightly lower than the line H—H.

The light distribution pattern P2 that forms the right-side hot zone and the light distribution pattern P3 that forms the left-side hot zone are, as in the first embodiment, designed so as to form a hot zone HZ which is formed by the light reflected by the second reflectors 20L and 20R.

Figure 12:
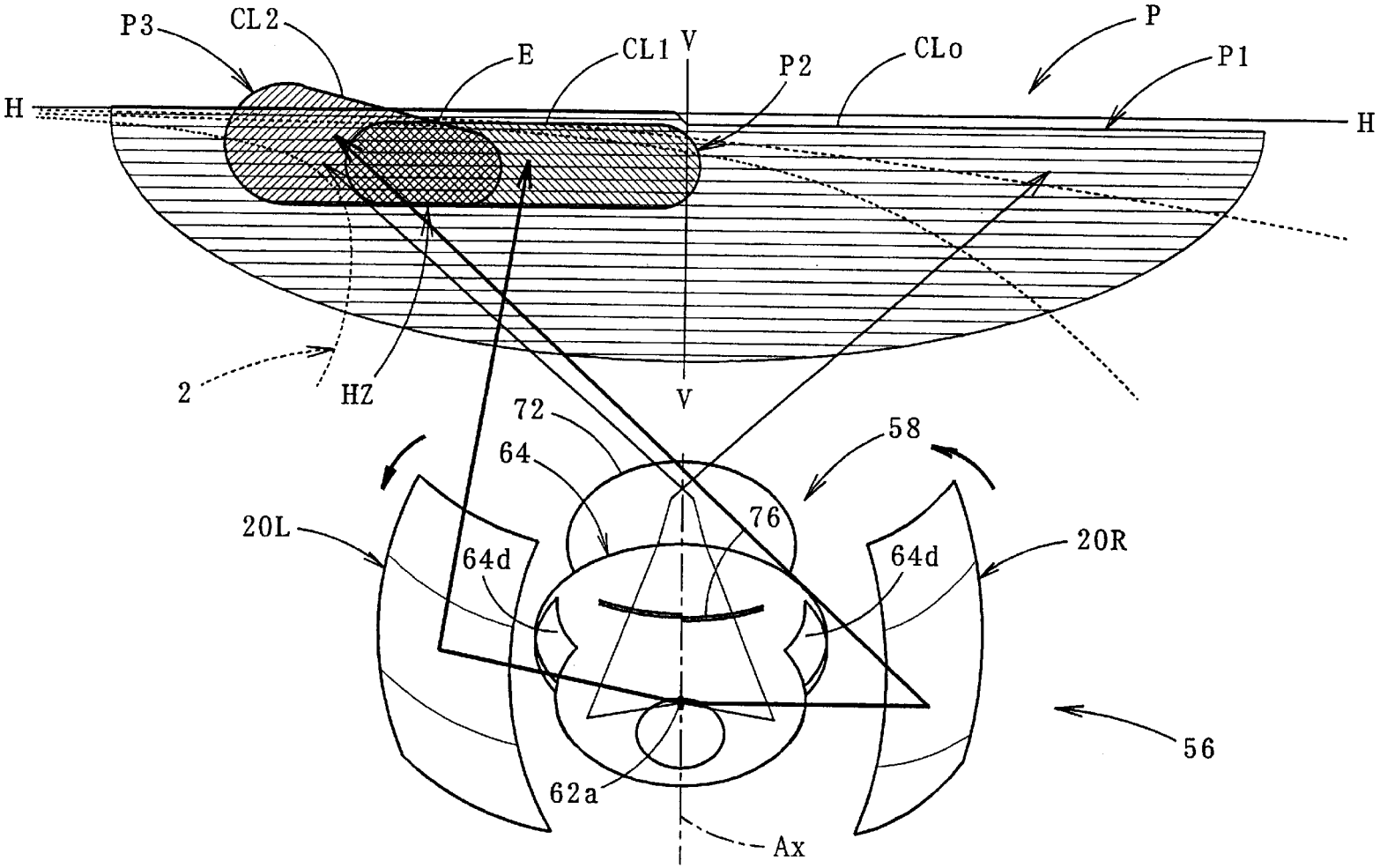
FIG. 12 is a perspective view taken from the back side of the lamp unit showing, together with the lamp unit, the low beam light distribution pattern formed by the beam emitted forward from the lamp unit, with each of the second reflectors in the leftward swing position.

FIG. 12 a perspective view taken from the back side of the lamp unit 56, showing the lamp unit 56 and the low beam light distribution pattern P formed by the beam emitted forward from the lamp unit 56. In FIG. 12, each of the second reflectors 20L and 20R is in the leftward swing position.

As seen from FIG. 12, when each of the second reflectors 20L and 20R is turned into the leftward swing position, the light distribution pattern P2 that forms the right-side hot zone and the light distribution pattern P3 that forms the left-side hot zone are moved to the left with respect to the reference position. As a result, the hot zone HZ is moved, together with the horizontal cutoff line CL1 and the oblique cutoff line CL2, to the left. Thus, when the vehicle traveling path 2 ahead of the vehicle is a leftward curved road, the road surface ahead in the vehicle traveling direction is sufficiently illuminated. In the shown embodiment, the right side second reflector 20R is swung or turned at an angle that is slightly greater than the left side second reflector 20L so as to move the light distribution pattern P3 that forms the left-side hot zone to the left slightly more than the light distribution pattern P2 that forms the right-side hot zone, thereby illuminating the road surface ahead in the vehicle traveling direction with a wider hot zone HZ. As a result, an overlapped area between the light distribution pattern P2 that forms the right-side hot zone and the light distribution pattern P3 that forms the left-side hot zone in the hot zone HZ becomes smaller to some extent compared to the low beam light distribution pattern P shown in FIG. 11.

The orientation of the base light distribution pattern P1 formed by the light reflected by the first reflector 24 is not moved in the above instance. Accordingly, the base light distribution pattern P1 keeps widely illuminating the vehicle front direction at all times.

Figure 13:
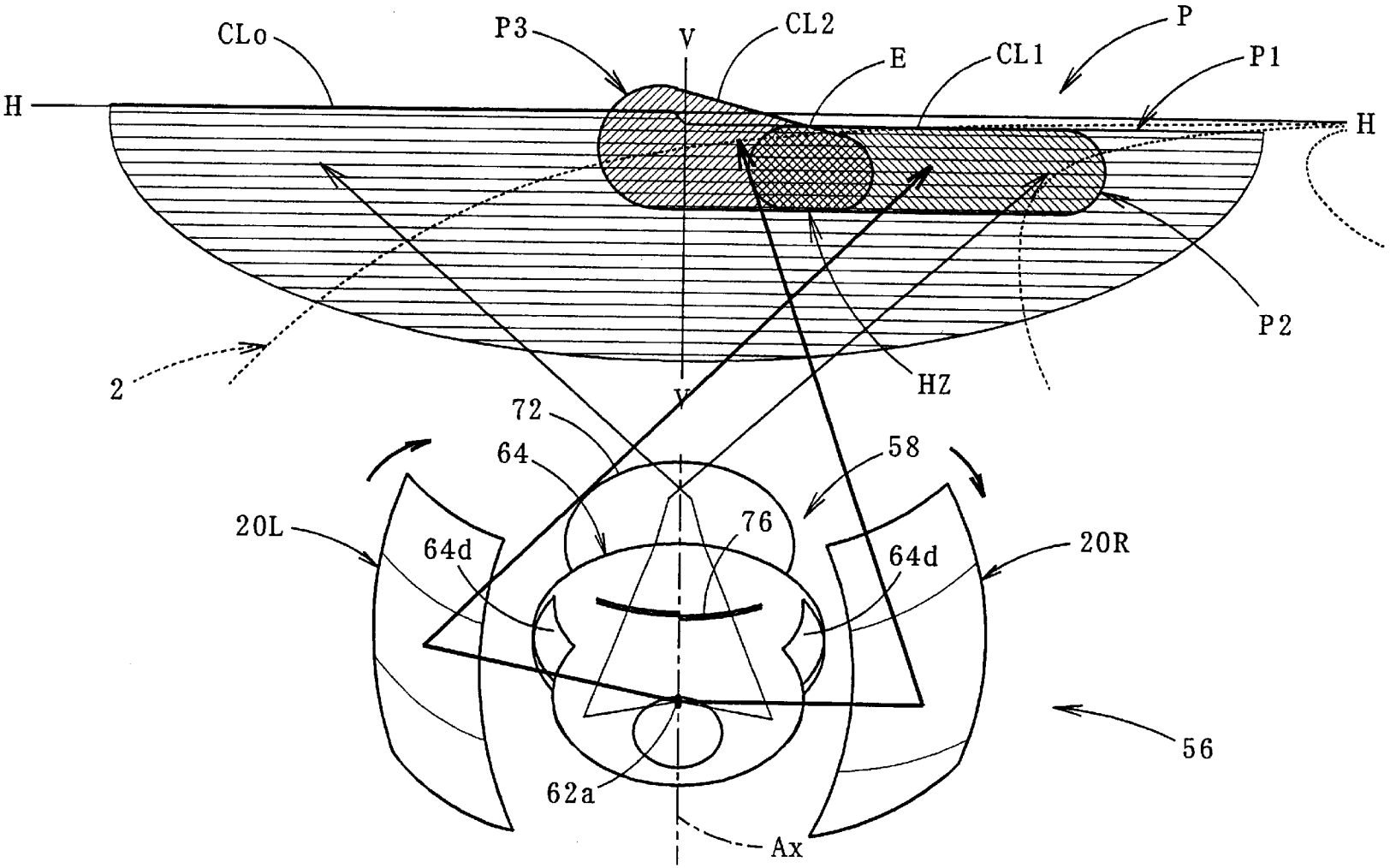
FIG. 13 is a perspective view taken from the back side of the lamp unit showing, together with the lamp unit, the low beam light distribution pattern formed by the beam emitted forward from the lamp unit, with each of the second reflectors in the rightward swing position.

FIG. 13 is a perspective view taken from the back side of the lamp unit 56, showing the lamp unit 56 and the low beam light distribution pattern P formed by the beam emitted forward from the lamp unit 56. In FIG. 13, each of the second reflectors 20L and 20R is in the rightward swing position.

As seen from FIG. 13, when each of the second reflectors 20L and 20R is turned into the rightward swing position, the light distribution pattern P2 that forms the right-side hot zone and the light distribution pattern P3 that forms the left-side hot zone are moved to the right with respect to the reference position. As a result, the hot zone HZ is moved, together with the horizontal cutoff line CL1 and the oblique cutoff line CL2, to the right. Thus, when the vehicle traveling path 2 ahead of the vehicle is a rightward curved road, the road surface ahead in the vehicle traveling direction is sufficiently illuminated. In the shown embodiment, the left side second reflector 20L is swung or turned at an angle that is slightly greater than the right side second reflector 20R so as to move the light distribution pattern P2 that forms the right-side hot zone to the right slightly more than the light distribution pattern P3 that forms the left-side hot zone, thereby illuminating the road surface ahead in the vehicle traveling direction with a slightly wider hot zone HZ. As a result, an overlapped area between the light distribution pattern P2 that forms the right-side hot zone and the light distribution pattern P3 that forms the left-side hot zone in the hot zone HZ becomes smaller compared to the low beam light distribution pattern P shown in FIG. 12.

The orientation of the base light distribution pattern P1 formed by the light reflected by the first reflector 64 is not moved in the above instance. Accordingly, the base light distribution pattern P1 keeps widely illuminating the vehicle front direction at all times.

As described above in detail, the vehicle headlamp 50 of the second embodiment is constructed so that the lamp unit 56 housed inside the lamp body 14 is used to emit forward a beam in the low beam light distribution pattern P that has the hot zone HZ. The lamp unit 56 is comprised of the lamp unit main body 58 and the pair of second reflectors 20L and 20R disposed on both sides of the lamp unit main body 58. In addition, the lamp unit main body 58 is supported by the lamp body 14, and each of the second reflectors 20L and 20R is supported so as to swing or turn in the lateral direction with respect to the lamp unit main body 58. Thus, the present invention provides the operational effects as described below.

By way of swinging or turning each of the second reflectors 20L and 20R in the lateral direction (or in the left and right directions) with respect to the lamp unit main body 58, it is possible to move the position of the hot zone HZ in the lateral direction (or in the left and right directions) while keeping the base light distribution pattern P1 that has the entire shape of the low beam light distribution pattern P to face the vehicle front direction.

Accordingly, by swinging or turning the second reflectors 20L and 20R in the lateral direction with respect to the lamp unit main body 58 according to vehicle running conditions, it is possible to have the light reflected by each of the second reflectors 20L and 20R sufficiently illuminated the road surface ahead in the vehicle traveling direction when the vehicle is running not only on a straight road but also on a curved road. In addition, since the light reflected by the first reflector 64 keeps the vehicle front direction widely illuminated at all times, the driver can avoid feeling unsecured even while driving on a curved road.

As seen from the above, the present invention provides a vehicle headlamp that houses a lamp unit in its lamp body and emits a beam in a light distribution pattern which is variable in response to vehicle running conditions.

Moreover, in the above embodiment, the second reflectors 20L and 20R swing or turn in the lateral direction independently to each other. Accordingly, the light reflected by each of the second reflectors 20L and 20R can be set to any desired direction, which allows more finely controlled light distribution according to the vehicle running conditions.

In addition, in the above embodiment, the position of the swing axis A of each of the second reflectors 20L and 20R is set on a perpendicular axis that passes through the first focal point F1 of the first reflector 64. Accordingly, the shape of the light distribution pattern P2 that forms the right-side hot zone and the shape of the light distribution pattern P3 that forms the left-side hot zone, both being formed by the second reflectors 20L and 20R, are less likely deformed (and so is the shape of the hot zone HZ) even when each of the second reflectors 20L and 20R is made to swing in the lateral direction. As a result, a proper beam control can be performed even when the vehicle is running on a curved road.

Furthermore, in the above second embodiment, each of the second reflectors 20L and 20R is supported by the lamp unit main body 58 at two points thereof or at upper and lower portions of each second reflector. Accordingly, each of the second reflectors 20L and 20R swings in the lateral direction while being supported at two points in the vertical direction. Thus, accuracy of the swing angle position of each of the second reflectors 20L and 20R is enhanced, and the hot zone HZ formed by the light reflected by each of the second reflectors 20L and 20R is prevented from being blurred that would be caused by, for instance, vibrations of the vehicle.

In each of the above first and second embodiments, the base light distribution patterns P1 formed by the light reflected by the first reflectors 24 and 64 illuminate the entire area of the low beam light distribution patterns P. Thus, the base light distribution pattern P1 of the first embodiment has on its top end portion the horizontal cutoff line and the oblique cutoff line, and the base light distribution pattern P1 of the second embodiment has on its top end portion the stepped horizontal cutoff line. It is nonetheless possible, in addition to these light distribution patterns, to employ a light distribution pattern that has only a horizontal cutoff line on the top end portion thereof or has no cutoff lines at all on the top end portion thereof.

In the vehicle headlamps 10 and 50 according to the above embodiments, each of the second reflectors 20L and 20R swings or turns according to the running conditions of the vehicle. This control of swing can be performed according to, for example, the shape of the vehicle traveling path ahead of the vehicle, the vehicle speed, or other factors. In such a control, it is possible to recognize the shape of the vehicle traveling path based on, for example, map data offered by a navigation device, image data representing the vehicle traveling path ahead of vehicle captured by a CCD camera, a steering angle, or other data.

Specific examples of swing control according to the shape of the vehicle traveling path ahead of a vehicle are as described above. In the present invention, each of the second reflectors 20L and 20R is controlled so as to swing independently from each other. Accordingly, the swing angle of the second reflectors 20L and 20R can be set differently from each other for a leftward curved road and for a rightward curved road. This ensures even more appropriate beam emission when the vehicle is running on a curved road.

The swing control according to the vehicle speed is accomplished, for instance, as follows: in a low vehicle speed range, a wider hot zone HZ is formed so as to illuminate widely the vehicle traveling path ahead of the vehicle; while, as the vehicle speed increases, the width of the hot zone HZ is made narrower so as to illuminate the area near the elbow point E with a greater luminous intensity, thereby enhancing remote visibility. More specifically, the swing control in this case can be accomplished by way of swinging each of the second reflectors 20L and 20R gradually closer to the optical axis Ax as the vehicle speed increases, thus enlarging the overlapped area between the light distribution pattern P2 that forms the right-side hot zone and the light distribution pattern P3 that forms the left-side hot zone in the hot zone HZ.

What is claimed is:

1. A vehicle headlamp comprising a lamp body and a lamp unit housed inside said lamp body so that said lamp unit emits forward a beam of a predetermined light distribution pattern that has a hot zone, wherein said lamp unit comprises:

a lamp unit main body comprised of a light source and a first reflector that supports said light source and reflects a light from said light source forward, and a pair of second reflectors, each of said pair of second reflectors being provided on both outsides of said first reflector of said lamp unit main body and at positions into which a light from said light source enters so that said second reflectors reflect a light from said light source forward and form a hot zone; and wherein said lamp unit main body is supported by said lamp body, and each of said second reflectors is supported so as to make a swing in a lateral direction with respect to said lamp unit main body.

2. The vehicle headlamp according to claim 1, wherein said swing in said lateral direction of each of said second reflectors is made independently from each other.

3. The vehicle headlamp according to claim 1, wherein an axis of said swing of each of said second reflectors is on a perpendicular axis extending near said light source.

4. The vehicle headlamp according to claim 1, wherein each of said second reflectors is supported by said lamp unit main body at upper and lower portions thereof.

5. The vehicle headlamp according to claim 1, wherein:

said light source is disposed in substantially coaxial with an optical axis that extends in a longitudinal direction of a vehicle;

said first reflector is provided so as to reflect said light from said light source forward and close to said optical axis;

said lamp unit main body further comprises a condensing lens provided in front of said first reflector and a shade provided between said condensing lens and said first reflector so as to shield part of light reflected by said first reflector; and opening portions for allowing said light from said light source to enter into each of said second reflectors are formed on both sides of said first reflector, respectively.

6. The vehicle headlamp according to claim 2, wherein an axis of said swing of each of said second reflectors is on a perpendicular axis extending near said light source.

7. The vehicle headlamp according to claim 2, wherein each of said second reflectors is supported by said lamp unit main body at upper and lower portions thereof.

8. The vehicle headlamp according to claim 2, wherein:

said light source is disposed in substantially coaxial with an optical axis that extends in a longitudinal direction of a vehicle;

said first reflector is provided so as to reflect said light from said light source forward and close to said optical axis;

said lamp unit main body further comprises a condensing lens provided in front of said first reflector and a shade provided between said condensing lens and said first reflector so as to shield part of light reflected by said first reflector; and opening portions for allowing said light from said light source to enter into each of said second reflectors are formed on both sides of said first reflector, respectively.

* * * * *